US005121588A

United States Patent [19]

Abate

[11] Patent Number: 5,121,588

[45] Date of Patent: Jun. 16, 1992

[54] DEVICE FOR USE WITH A PACKAGING MACHINE FOR CONTINUOUS SINGULATING OF A PACKAGING CONTAINER CHAIN

[75] Inventor: Alessandro Abate, Mercogliano, Italy

[73] Assignee: Italpack s.r.l., Italy

[21] Appl. No.: 408,089

[22] Filed: Sep. 15, 1989

[30] Foreign Application Priority Data

Jun. 6, 1989 [IT] Italy ..... 4838 A/89

[51] Int. Cl.[5] ..... B65B 61/06; B65B 61/08; B65B 51/32

[52] U.S. Cl. ..... 53/375.9; 53/387.3; 53/389.3; 83/111; 83/331; 83/552

[58] Field of Search ..... 83/552, 628, 331, 111, 83/646; 53/113, 551, 378, 379, 560, 234, 559, 387, 388, 375.9, 387.3, 387.4, 389.3

[56] References Cited

U.S. PATENT DOCUMENTS

| | | | |
|---|---|---|---|
| 2,878,630 | 3/1959 | Stirn et al. | 53/560 |
| 2,952,105 | 9/1960 | Schur | 53/234 X |
| 3,006,121 | 10/1961 | Omori | 53/551 |
| 3,320,718 | 5/1967 | Thesing | 53/551 |
| 3,543,471 | 12/1970 | Youngman | 53/234 X |
| 3,844,091 | 10/1974 | Vedvik et al. | 53/559 X |
| 4,510,732 | 4/1985 | Löthman | 53/378 X |
| 4,614,078 | 9/1986 | Kawabe | 53/551 |
| 4,891,929 | 1/1990 | Branchi . | |

FOREIGN PATENT DOCUMENTS

| | | |
|---|---|---|
| 1212850 | 3/1966 | Fed. Rep. of Germany . |
| 1221954 | 7/1966 | Fed. Rep. of Germany . |
| 2109328 | 6/1983 | United Kingdom . |

*Primary Examiner*—Horace M. Culver
*Attorney, Agent, or Firm*—Dilworth & Barrese

[57] ABSTRACT

A device for use with a packaging machine for continuous singulating of a packaging container chain. A frame is provided having a circular shape to guide a packaging container chain along a predetermined circular track. The container chain includes a plurality of uniformly spaced container zones joined together by link zones. A plurality of knives are positioned along the frame at areas corresponding to the link zones and move in a direction perpendicular to the track to sever the packaging container chain at each of the link zones.

20 Claims, 20 Drawing Sheets

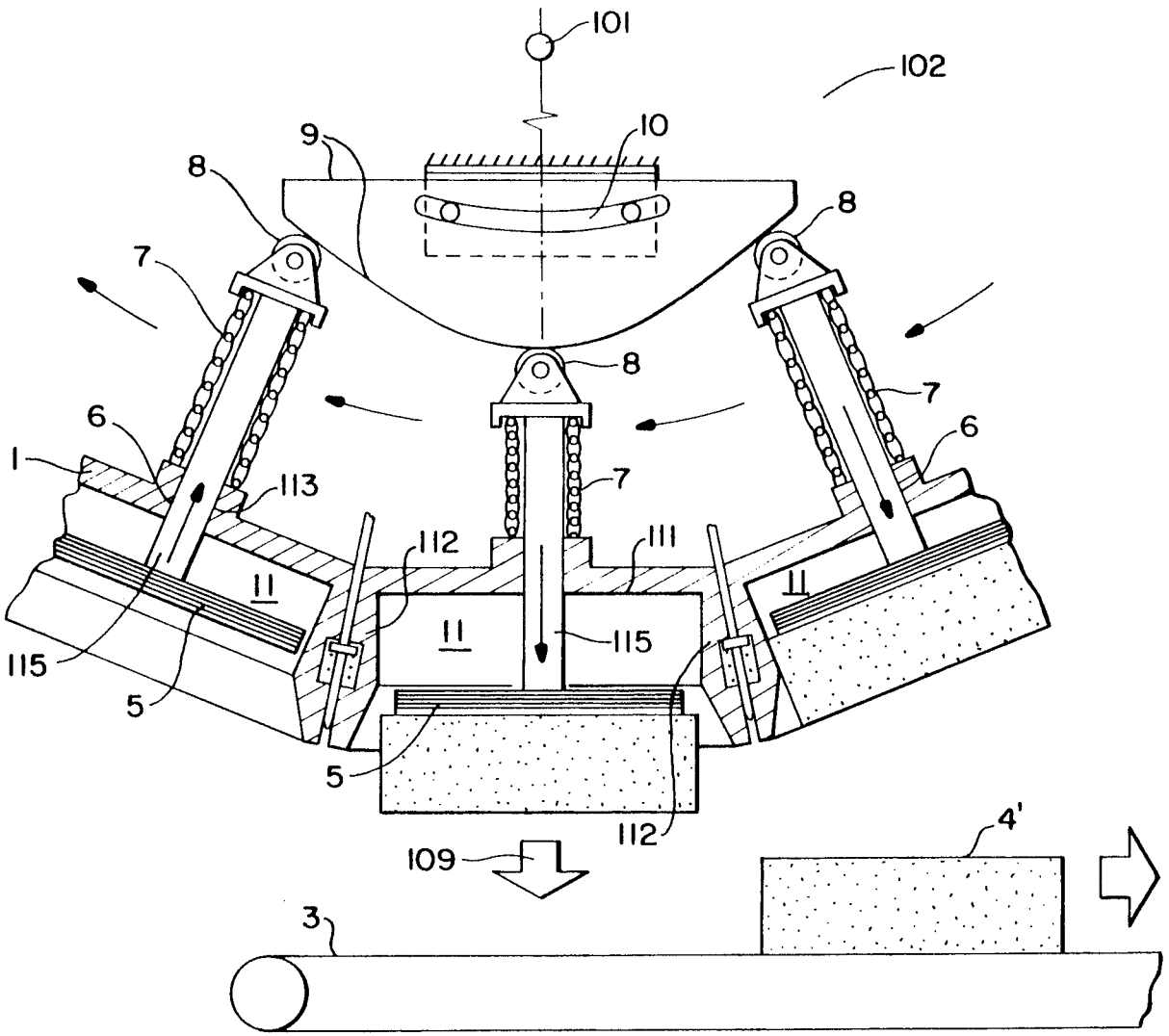
FIG. 3
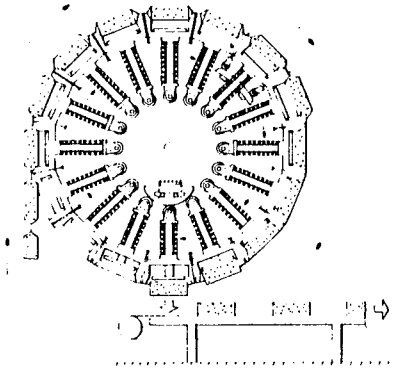

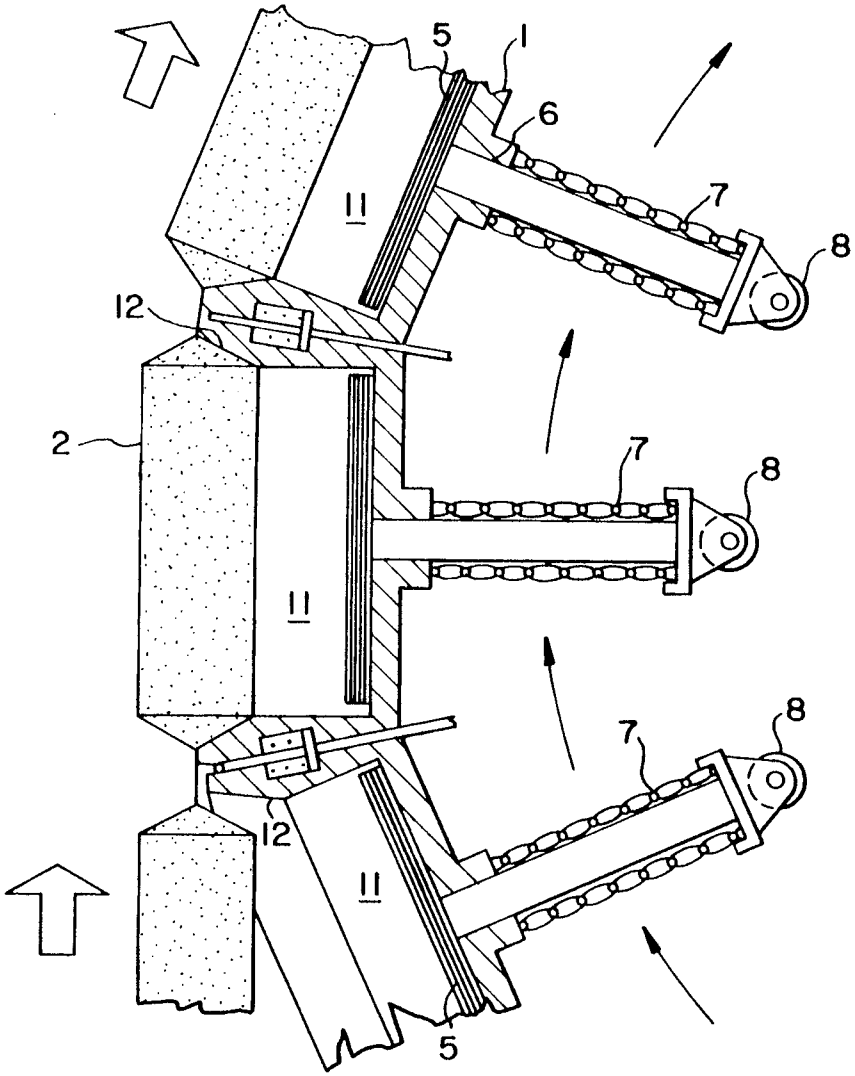
FIG.5
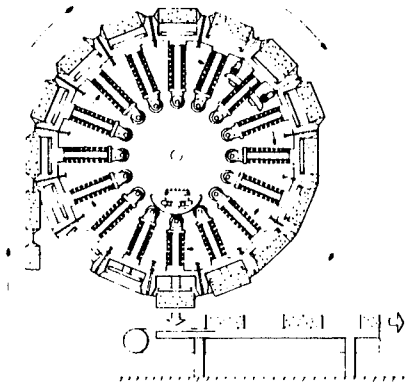

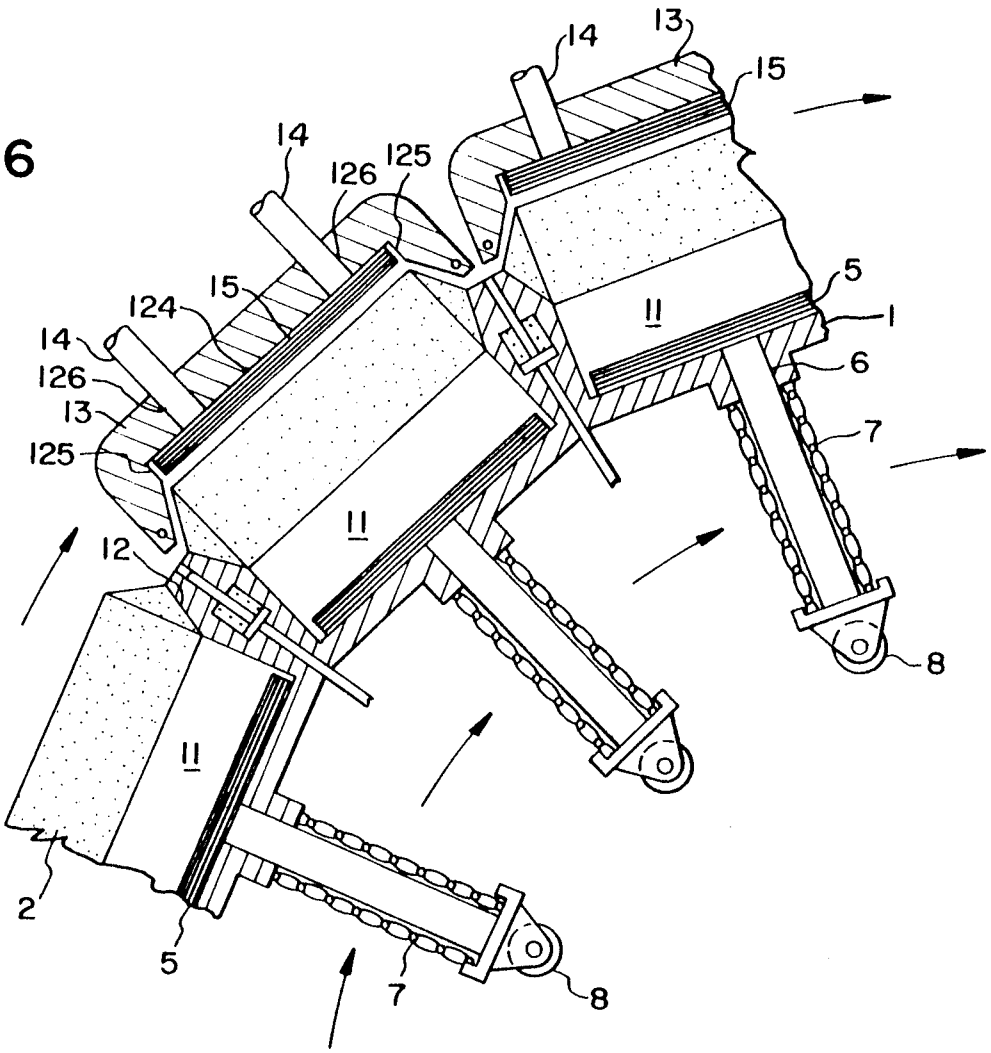
FIG. 6
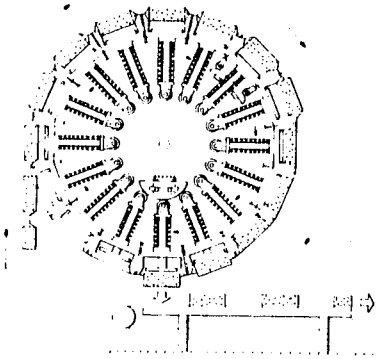

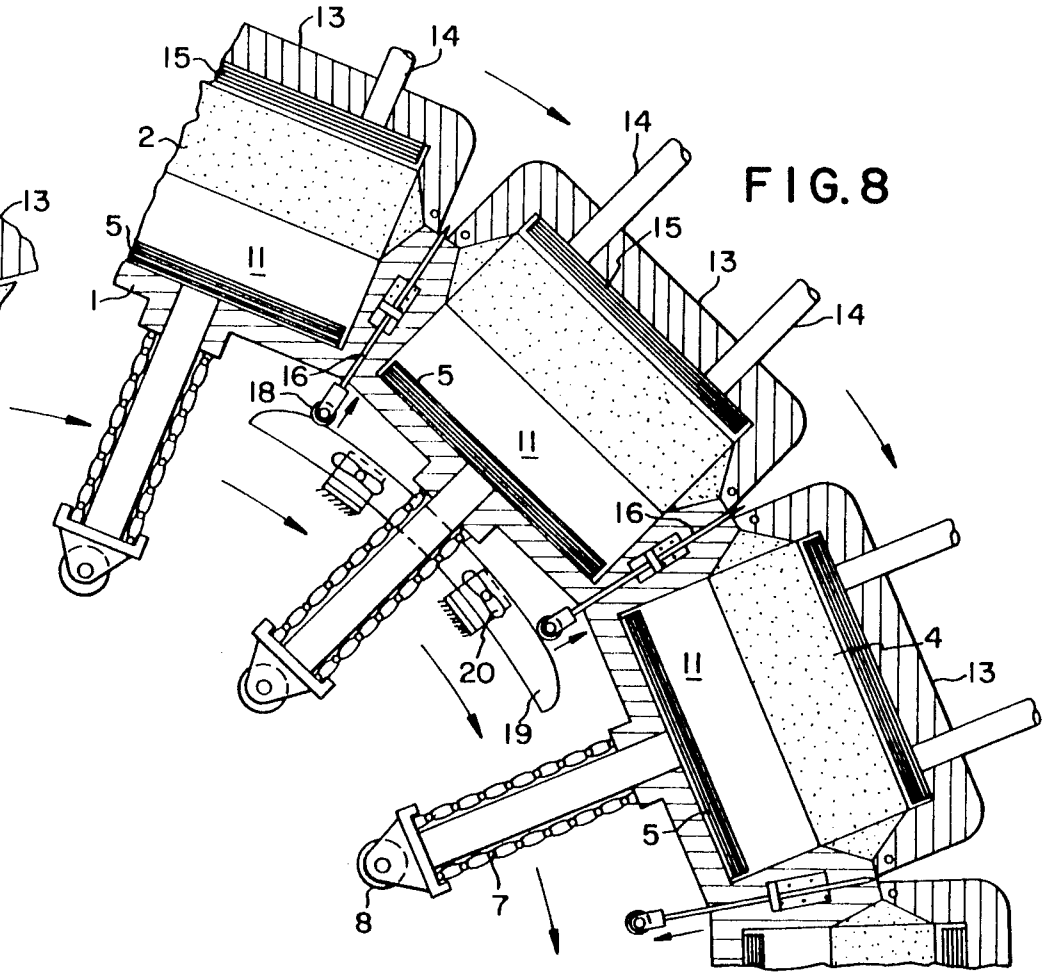
FIG. 8
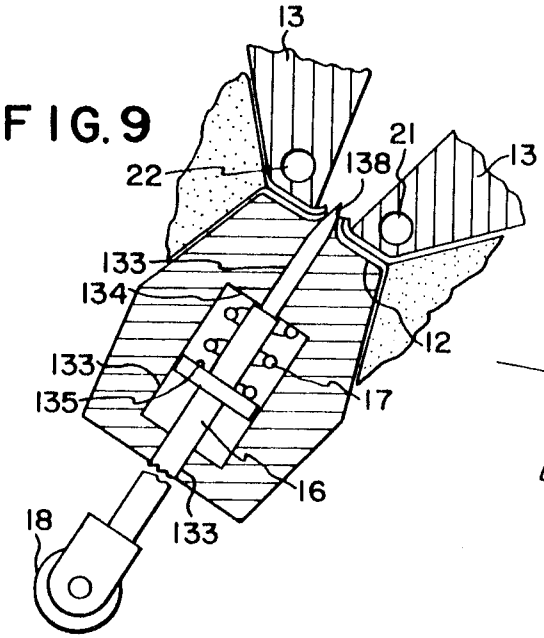
FIG. 9
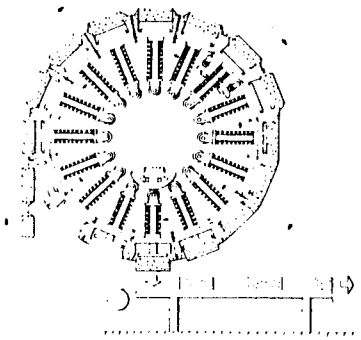

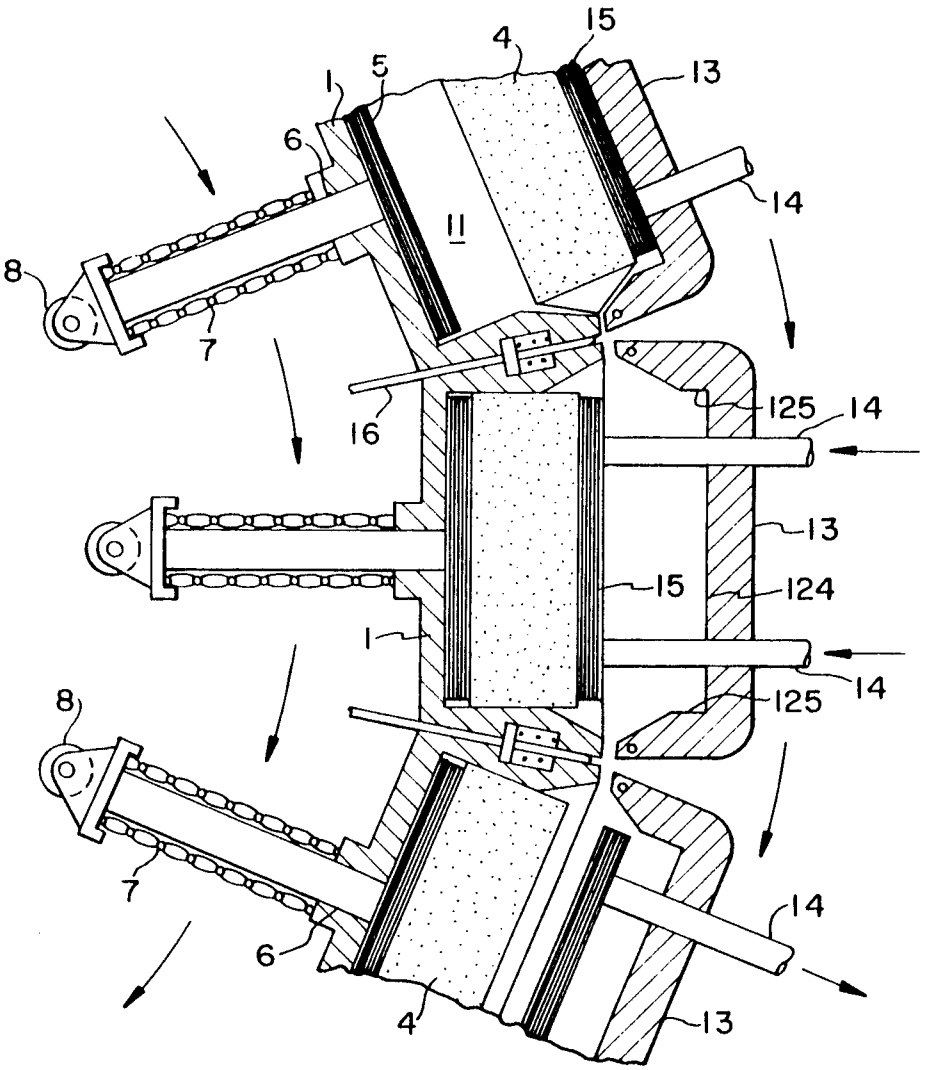
FIG.10
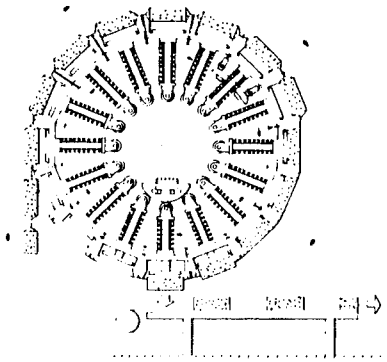

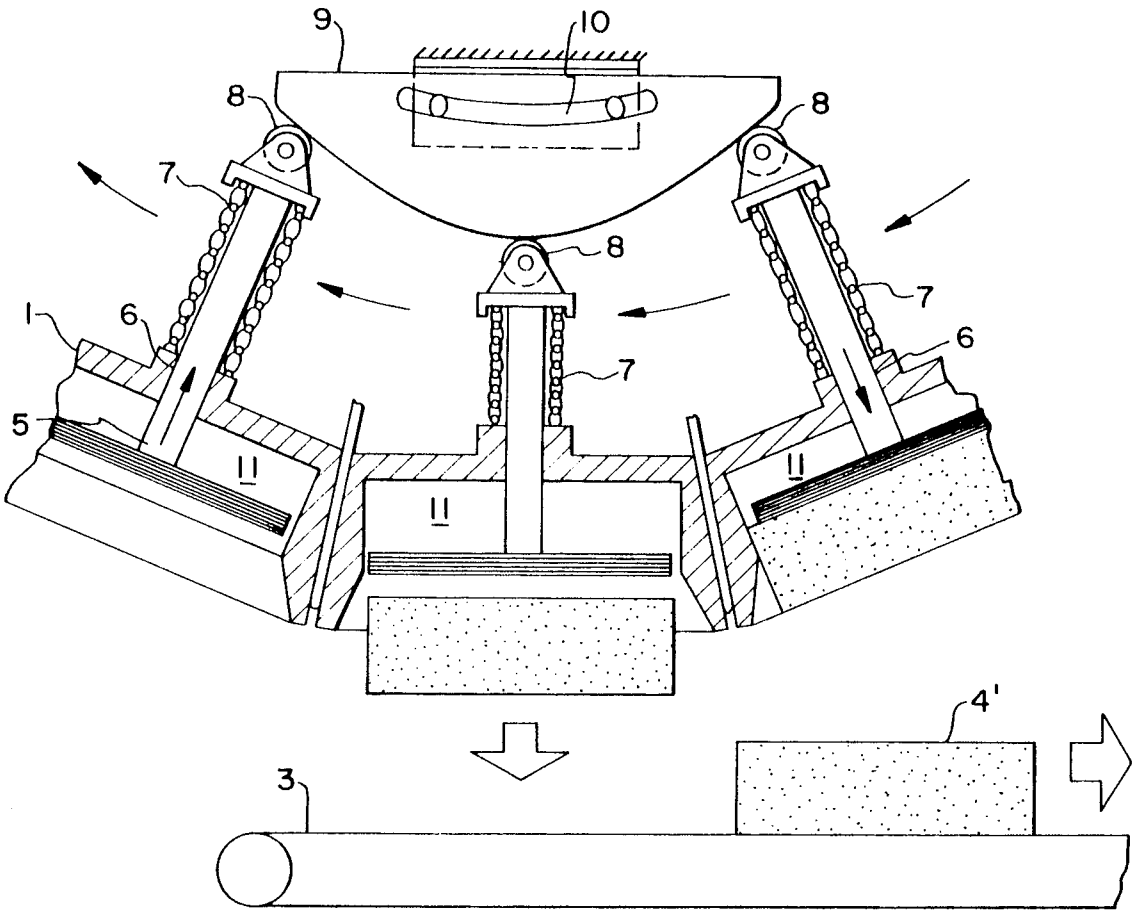
FIG. 13
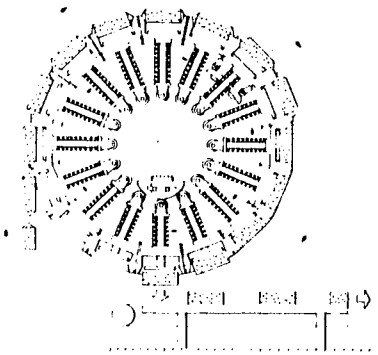

DEVICE FOR USE WITH A PACKAGING MACHINE FOR CONTINUOUS SINGULATING OF A PACKAGING CONTAINER CHAIN

BACKGROUND OF THE INVENTION

1. Field of the Invention

The present invention relates to a packaging device for continuous singulating and packaging of a plurality of packaging containers connected in a chain.

2. Description of the Prior Art

Devices for packaging goods, preferably liquids, are known in the art. There presently exists a need for an apparatus capable of continuously singulating and packaging of a plurality of packaging containers on a continuous basis. The present invention relates to such an apparatus.

SUMMARY OF THE INVENTION

The packaging device according to the invention consists of a frame in which the packaging container chain consisting of uniformly spaced container zones and link zones connecting these can be guided along a prescribed track and of a plurality of knives which are located at the pitch of the link zones of the packaging container chain and can move along this at the same speed and can be engaged in a direction at right angles to the packaging container chain with its link zones in order to sever the chain. With this embodiment it is possible to process the connected packaging container chain continuously. This container chain is severed at the link zones connecting the container zones during its travel along the prescribed track. The containers on the cahin are, therefore, singulated.

Advantageous improvements to the invention are described in the dependent claims. In the preferred embodiment, a plurality of uniformly spaced pockets are provided which are located between the knives, can travel with the knives in the direction of travel of the packaging container chain and correspond in size to the container zones of the packaging container chain, into each of which pockets a container zone can be inserted and removed after the link zones have been severed. While the containers which have already been singulated by the knives are in the pockets they can be processed. In particular it is possible to weld the ends of the containers. The pockets can be configured such that the tabs or flaps at the ends of the containers are located against the main body of the container. To this end the pockets are preferably configured in a cuboid shape. The dimensions of the cuboid correspond to those of the container in its final cuboid shape. After processing, the finished containers are discharged from the pockets and placed or dropped onto a conveyor belt.

A particularly advantageous embodiment is provided if a disc is mounted in the frame such that it can rotate about a horizontal axis, and the container chain can travel along a circular track on its peripheral surface. A circular track has proved particularly successful for the container chain because it is easy to implement in engineering terms by means of a rotating disc and because of its particularly spaced-saving design.

The pockets which accommodate the singulated containers are preferably located on the peripheral surface of the disc and consist of a base which is configured tangential to the periphery of the disc and of lateral surfaces connected radially to this. An advantageous improvement is characterised in that a discharge plate which can be moved radially is provided on the base of each pocket. This permits the containers accommodated in the pockets to be discharged from these pockets with particular ease.

A further advantageous improvement is characterised in that in the base of each pocket a radial guideway is located in which a gudgeon is mounted such that it can be displaced longitudinally and which has the discharge plate on its outer radial end and a roller which runs over a frame-mounted cam track on its inner radial end. In this way, the movement of the discharge plate which removes the singulated containers from their pockets can be easily generated by a cam-driven system. In the preferred embodiment, a compression spring encompassing the gudgeon is provided between a stop on the pocket and a stop on the gudgeon. The gudgeon is, therefore, under load since the discharge plate is normally retained against the base of the pocket. As a result of the cam track engaging the gudgeon-mounted roller, this gudgeon is moved radially outwards together with the discharge plate against the compressive force of the spring in order to discharge the container from the pocket.

In the preferred embodiment, each knife located in the zone between two pockets on the disc is mounted such that it can be longitudinally displaced in a radial guideway. A roller which runs over a frame-mounted cam track can be mounted on the inner radial end of each knife. A compression spring encompassing the knife is preferably located between a disc-mounted stop and a stop on the knife. In this way, the knife is pressure-loaded in its radial guideway between the pockets such that its outer radial zone holding the knife blade is normally within the disc periphery, i.e. it does not project beyond the disc but is countersunk inside its sleeve.

In the zone in which the knives are designed to move radially outwards in order to sever the link zones of the container chain a frame-mounted cam track is located which moves the rollers and thus the knives radially outwards against the compressive force of the springs with the result that the knives protrude beyond the periphery of the disc and can sever the link zones of the container chain.

An advantageous improvement is characterised: by a housing-mounted cylinder coaxial with the rotational axis of the disc in the peripheral surface of which a guide slot is located; by guide rods each allocated to a pocket, which guide rods are firmly connected to the disc and overlap the peripheral surface of the cylinder parallel to the rotational axis of the disc; and by housing brackets each allocated to a pocket, which brackets can be displaced longitudinally along the guide rods and which, on their inner radial end, have a roller tracking in the guide slot of the cylinder and, on their outer radial end, a radially inward facing housing which consists of a tangential base and two lateral surfaces protruding radially inwards and which can be positioned opposite a pocket. This embodiment serves to hold the containers during the action of the knife. Before the knife is operated, the container zones of the still linked container chain are located in the upper, possibly bevelled zones of the pockets, i.e. they have not been inserted into the pockets at this stage. The housing described above can then act on the upper half of each container zone. Its shape is designed to match that of the upper half of the container zones. The movement of the housings in an axial direction is not impeded by the upper half of the container zones since the housings are open axially. Radially, however, they are provided with two lateral surfaces protruding radially inwards from the base of each housing. The whole internal shape of the housing is designed to match that of the upper half of the container zones of the container chain. The movement of the housing in an axial direction is controlled by means of the guide slot of the cylinder and the housing bracket roller tracking therein.

In the preferred embodiment, the base of each housing is provided with a radially movable push plate with the aid of which a container already singulated by the knives can be inserted into the relevant pocket with particular ease.

A radial guideway can be provided in the base of each housing in which a longitudinally displaceable gudgeon can be mounted which has on its inner radial end the push plate and which, on its outer radial end, is in the form of a piston of a piston/cylinder unit mounted on the housing. If the piston/cylinder unit, therefore, is actuated, the gudgeon together with the push plate can be moved radially inwards to push the container into the pocket.

An advantageous improvement is characterised in that: each housing is rotationally mounted on a separator, which is in turn mounted such that it is longitudinally displaceable on the guide rods and bears the roller which tracks in the guide slot of the cylinder, about a tangentially acting rotational axis for the housing which is located at the same distance from the rotational axis of the disc as the disc's peripheral surface; and that a guide lever, which can engage a disc-mounted cam track such that the housing can be moved towards the appropriate pocket, is provided on the housing radially inwards from the rotational axis of the housing. The separator can be moved together with the housing in an axial direction towards the disc by means of the cam track provided on the peripheral surface of the cylinder and the roller provided on the separator which interacts with it. In this way, therefore, the housing is positioned relative to the pocket. The definitive location of the housing then occurs by means of the interaction of the housing guide lever with the disc-mounted cam track. The embodiment is designed such that the engaging of the guide lever in the cam track results in a rotation of the housing about the housing rotational axis which mates the inner radial ends of the housing's lateral surfaces with the outer radial periphery of the disc. As a result, the as yet still linked containers are clearly held in the link zone between the container zones; these link zones are pressed together and held fast between the outer radial ends of the housing's lateral surfaces and the outer peripheral surface of the disc.

If a tensile spring is located between the housing and the separator to act on the housing in the opposite direction to the pocket, the housing is tensioned in the direction of discharge. The interaction of the housing guide lever with the disc-mounted cam track as described above occurs, therefore, in opposition to the tensile force of the spring.

Every pocket can be provided in its outer radial zone with supporting surfaces facing diagonally outwards. At the beginning of processing the container zones of the still linked container chain lie with their diagonal end zones in contact with the diagonally outward facing supporting surfaces of the pockets. In this way they are reliably and accurately positioned such that they are each allocated to a pocket.

Every pocket can have a welding device in the region of the front end of the container. Such a welding device can also be provided in the region of the rear end of the container. In the preferred embodiment such welding devices will be electrically operated. These welding devices can be used if and when desired. They are used when the already singulated container has been pressed into the appropriate pocket and thus is cuboid in shape. It is possible to weld both ends of the container. The finished container is also then cuboid in shape. For certain applications it is, however, advantageous to weld only the base of the finished container. In this case only one welding device is used but not the other. The finished container then has a base on which it can stand reliably. At the other end the originally formed tabs are still available which makes the container more appealing externally.

BRIEF DESCRIPTION OF THE DRAWINGS

An embodiment of the invention is described in detail below with reference to the accompanying drawings, in which:

FIG. 3 shows an enlarged view of the device according to FIGS. 1 and 2, partially in section, in the region of the discharge of the containers from the pockets;

FIG. 5 shows the stage following on chronologically after FIG. 4 in which the container chain is mated with the upper surfaces of the pockets;

FIG. 6 shows the stage following on chronologically after FIG. 5 in which the housing is positioned on the upper side of the containers;

FIG. 8 shows the stage following on chronologically after FIG. 7 in which the link zones of the container chain are severed by the knives;

FIG. 9 shows a knife after severance of the link zones in an enlarged form;

FIG. 10 shows the stage following on chronologically after FIG. 8 in which the singulated containers are inserted in the pockets;

FIG. 13 shows the stage following on chronologically after FIG. 12 in which the containers are discharged from the pockets and deposited on a conveyor belt;

DETAILED DESCRIPTION OF THE PREFERRED EMBODIMENTS

Figure 1:
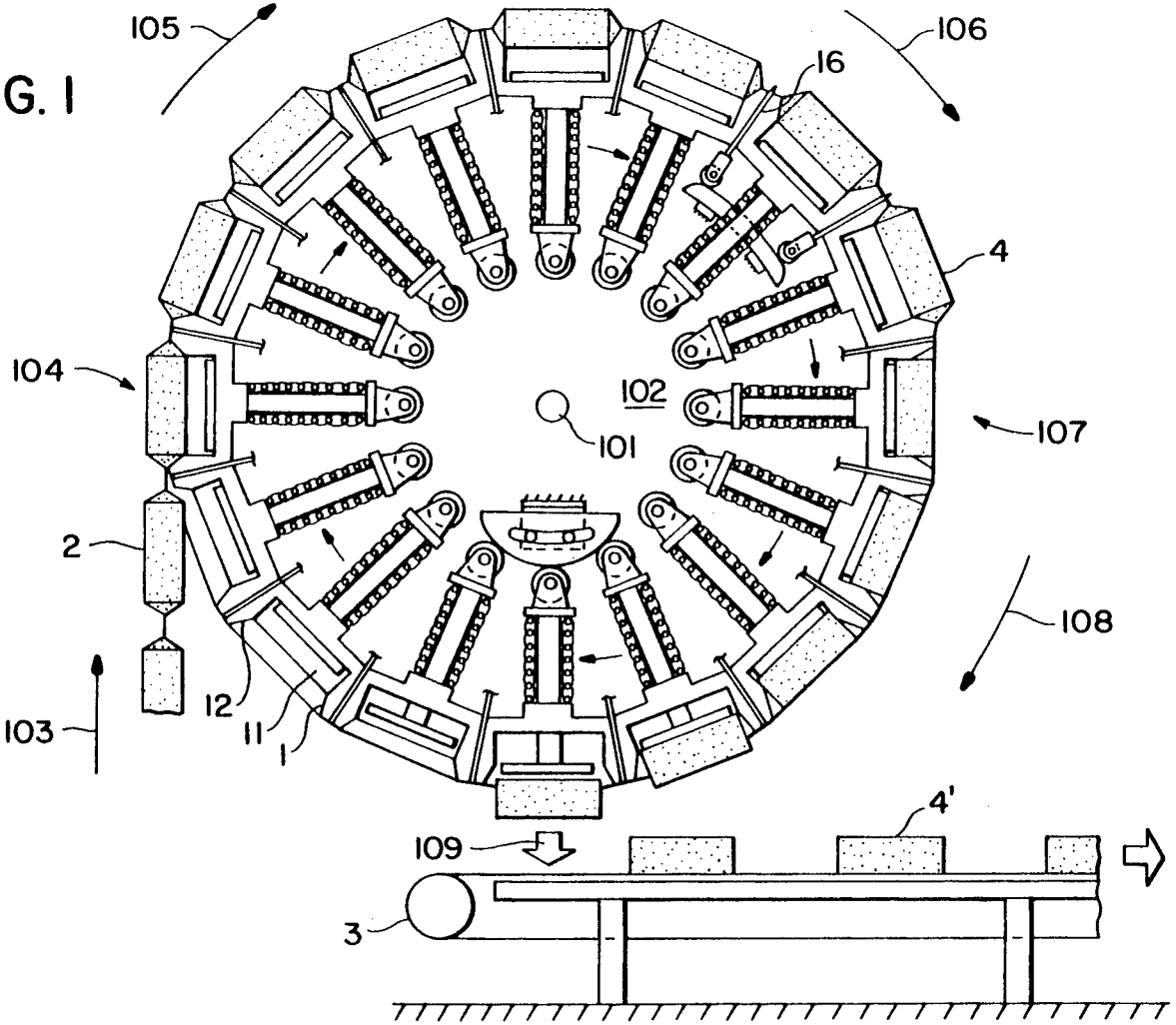
FIG. 1 shows a front view of the device when a first container shape is being made.

FIG. 1 shows the packaging device in a view from the front. The continuous packaging container consisting of uniformly spaced container zones and link zones connecting these is fed to a disc 102, which is rotationally mounted about a horizontal axis 101, in a tangential direction according to arrow 103. At the location designated 104 the containers mate with the upper bevelled surfaces 12 of the pockets 11. In the region of the arrow 105 the still linked containers are clamped by the housing (not shown in FIG. 1). In the region of the arrow 106 the knives 16 move radially outwards; they sever the container chain at the link zones. Subsequently the singulated containers are inserted into the pockets; this occurs at the location designated 107 by means of the push plates (not shown in FIG. 1) of the housing. In the region of the arrow 108 the containers are then welded at both ends. The containers leave the disc at the location designated 109. They are pressed out of the pockets by the pockets' discharge plates and fall onto the conveyor belt 3.

Since the containers have been welded at both ends, the result is the completely cuboid shape of the finished containers designated 4'.

Figure 2:
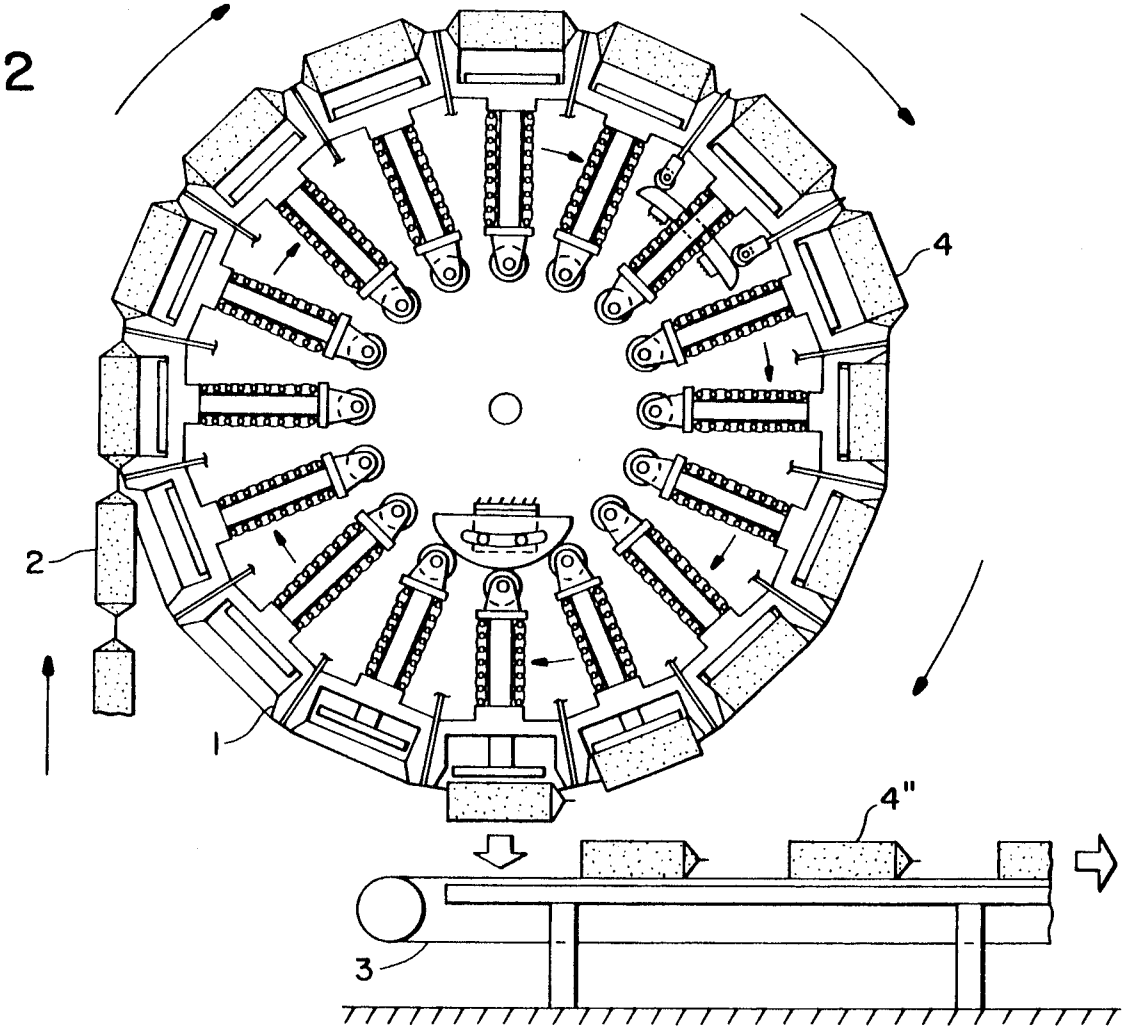
FIG. 2 shows a front view of the same device when a second container shape is being made.

FIG. 2 shows an embodiment which corresponds essentially to that of FIG. 1. The difference between this and FIG. 1 is that the containers are only welded at one end. This results in the finished container shape designated 4''. The base of the container is therefore essentially plane since this surface has been welded. The upper end of the finished container (shown on the right in FIG. 2) has the original "tab" shape again after leaving the pocket.

Figure 21:
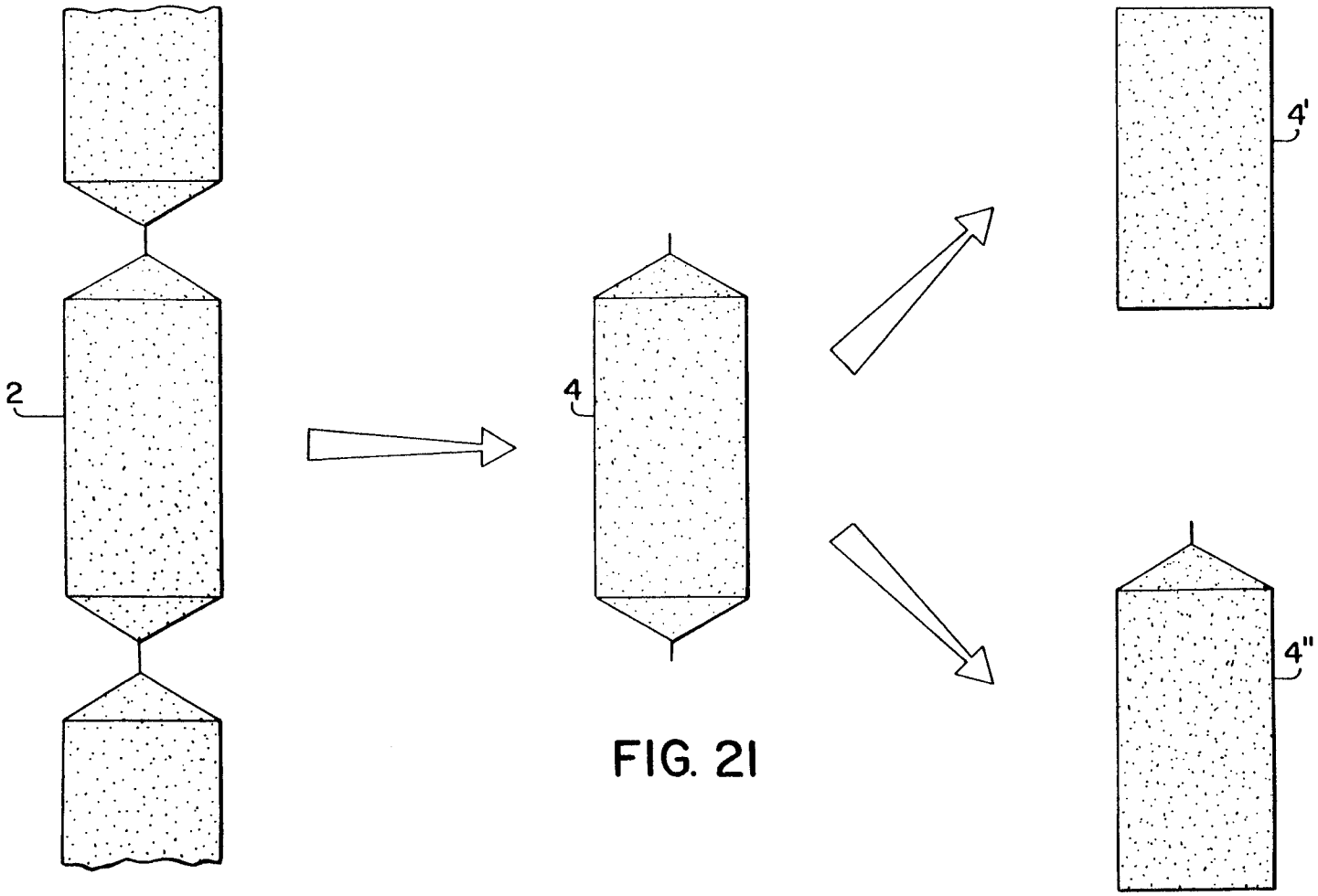
FIG. 21 is a schematic representation of the different container shapes which can be achieved with the device from a continuous container chain.

This situation is represented schematically in FIG. 21. The container chain 2 is first singulated. This results in the individual, but as yet unfinished containers 4. After welding there are two possible shapes. If both ends are welded the completely cuboid shape 4' is achieved. If only one end of the container 4 is welded the container shape 4'' with a stable base and tabs forming the upper end surface which is easy to grasp manually is achieved; this shape is desired in certain applications for mainly aesthetic reasons.

FIG. 3 shows an enlarged representation of the discharge area. The disc 102 which is rotationally mounted about the horizontal axis 101 has uniformly spaced pockets 11 in its radial peripheral surface. The pockets consist of a base 111 running tangentially to the disc periphery and of lateral surfaces 112 connected radially and spreading radially outwards. A radially movable discharge plate 5 is provided on the base 111 of each pocket 11. In the base 111 of each pocket 11 there is a radial guideway 113 in which a gudgeon 115 is mounted with longitudinal mobility, which gudgeon has the discharge plate 5 on its outer radial end and, on its inner radial end, a roller 8 which can move over a frame-mounted cam-track 9. The cam track 9 is configured in the discharge area shown in FIG. 3 such that the discharge plates 5 are moved radially outwards in order to remove the container from the pocket so that it can be deposited on the conveyor belt 3. A compression spring 7 encompassing the gudgeon 115 is provided between a stop on the pocket and a stop on the gudgeon 115. The gudgeon 115 is thus pre-tensioned by the spring 7 such that the discharge plate 5 is normally, i.e. without involvement of the cam track 9, located against the base 111 of the pocket 11.

The cam track 9 can be adjusted by means of the slot 10 and the threaded bolt located therein.

Figure 4:
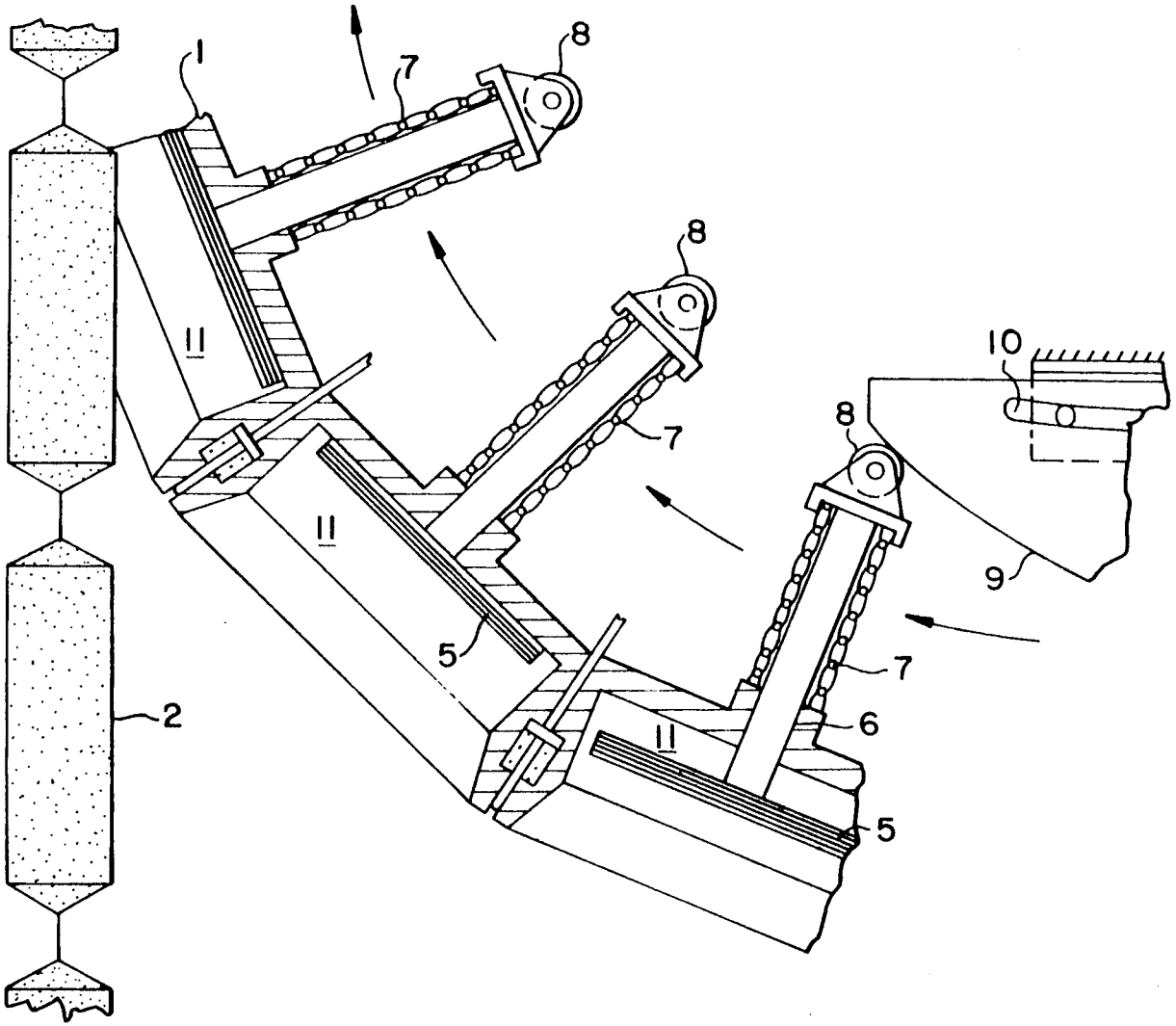
FIG. 4 shows an enlarged view of the device in the infeed region, i.e. in that region in which the container chain is fed towards the disc.
Figure 4:
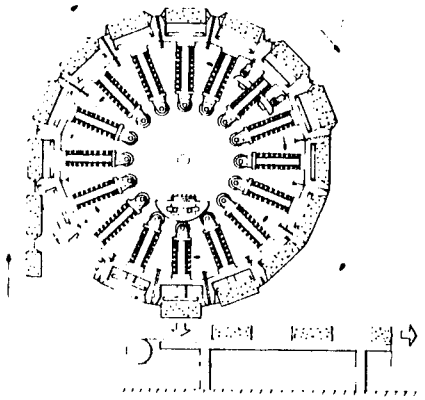

FIG. 4 shows the disc in the infeed area of the container chain 2. The container chain 2 is fed in the direction of the arrow 103.

FIG. 5 is an enlarged representation of the zone designated 104 in FIG. 1. The container zones 2 of the container chain mate with the upper bevelled faces 12 of the pockets 11. The link zones of the container chain between the container zones 2 each lie against the outer peripheral surface of the disc between two pockets.

Figure 14:
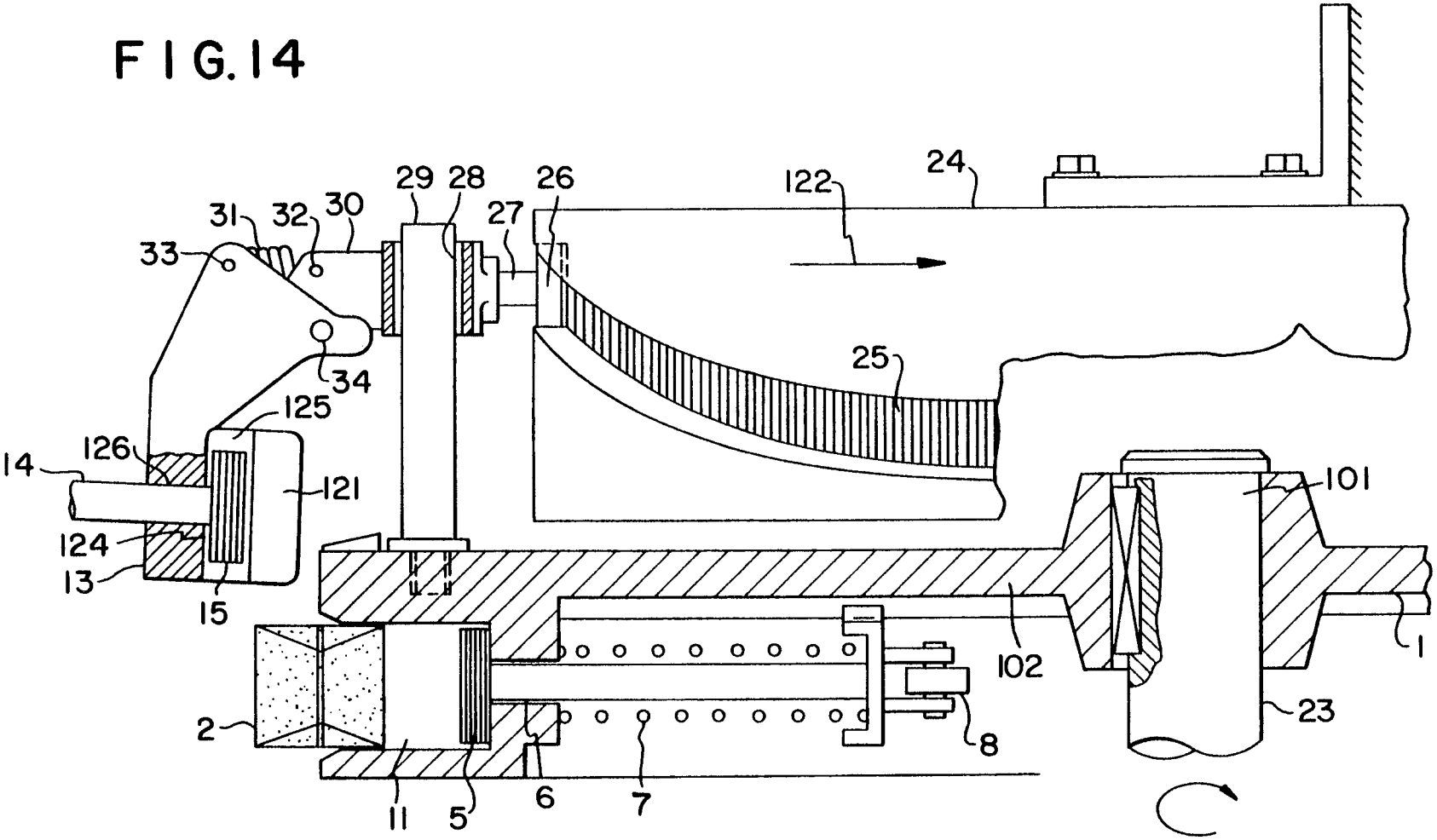
FIG. 14 shows a view of the device in a radial direction, partially in section, in the zone corresponding to FIG. 5.

FIG. 6 shows the interaction of the housings 13. Reference should first be made to FIG. 14 where the device is shown radially. The disc 102 is rotationally mounted about the horizontal axis 101. The shaft bears the reference number 23. The pockets 11 are located on the outer radial periphery of the disc 102. In the upper part of the pockets 11, the container chain 2 lies against their upper bevelled end faces 12 (cf. FIG. 5).

FIG. 14 shows additionally a housing-mounted cylinder 24 coaxial with the rotational axis 101 of the disc 102. A guide slot 25 is provided in the peripheral surface of the cylinder 24. One guide rod 29 is allocated to each pocket 11. It is possible to provide two guide rods per pocket. The guide rod 29 is firmly attached or bolted to the disc. It projects axially from the disc 102 and protrudes beyond the peripheral surface of the cylinder 24 parallel to the rotational axis 101 of the disc 102. A housing bracket 30, 13 is allocated to each pocket 11. The housing bracket consists of a separator 30 and the actual housing bracket 13. The separator 30 is provided with a guideway 28 along which it is connected to the guide rod 29 such that it can be longitudinally displaced. The separator 30 has on its side facing radially inwards a connecting element 27 on which a roller 26, which engages the guide slot 25 of the cylinder 24, is rotationally mounted. As can be seen from FIG. 14 the guide slot 25 in the cylinder 24 runs in the direction of rotation 122 of the disc 102 axial to this disc 102. As a result of the action of the guide roller 26, therefore, the separator 30 is moved in the rotational direction of the disc towards this disc 102 along the guide rod 29.

The rotational axis 34 of the housing is provided at the outer radial region of the separator 30. The rotational axis 34 of the housing runs in a tangential direction, i.e. tangential to the periphery of the disc 102. It remains at the same distance from the rotational axis 101 of the disc 102 as the outer peripheral surface of this disc 102. The housing bracket 13 is rotationally mounted about the housing rotational axis 34. The tensile spring 31 is tensioned between the point 32 on the separator 30 and the point 33 on the housing bracket 13. This ensures that the separator 30 and the housing bracket 13 normally, i.e. without any external influences, adopt the position relative to each other shown in FIG. 14. The housing 121, which is mounted on the housing bracket 13, consists of a tangential base 124 and two lateral surfaces 125 projecting radially inwards from this. The base 124 of each housing 121 is provided with a push plate 15 which can be moved radially. Furthermore, the base 124 of each housing is provided with a radial guideway 126 in which a gudgeon 14 is mounted such that it can be longitudinally displaced. The push plate 15 is mounted on its inner radial end, and at its outer radial end, the gudgeon 14 is in the form of the piston of a housing-mounted piston/cylinder unit (not shown in the drawings).

In FIG. 6 it can be seen that two gudgeons 14 are provided for every push plate 15 of a housing 13.

Figure 7:
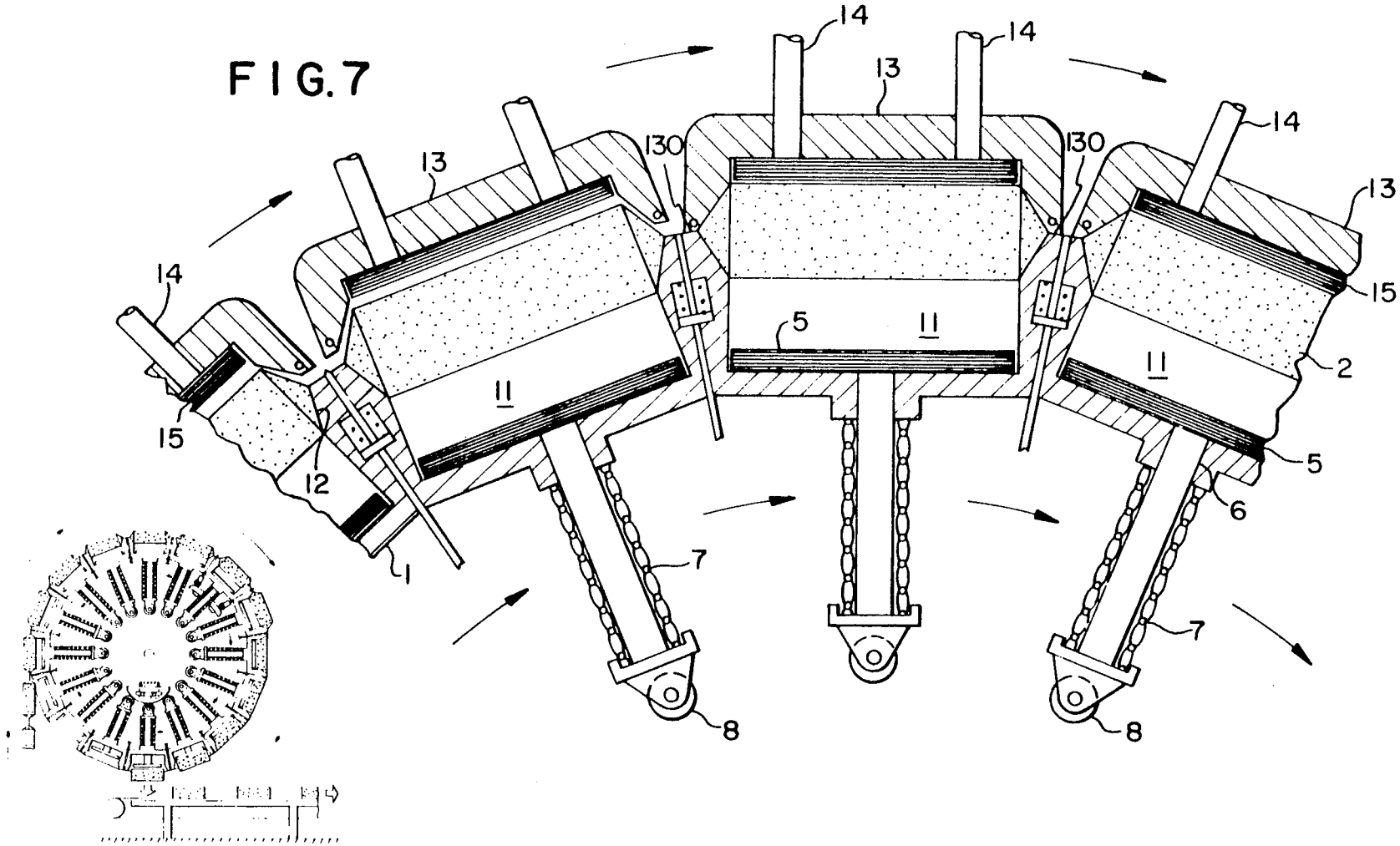
FIG. 7 shows the stage following on chronologically after FIG. 6 in which the link zones of the container chain are clamped between the outer peripheral surface of the disc and the housings.
Figure 15:
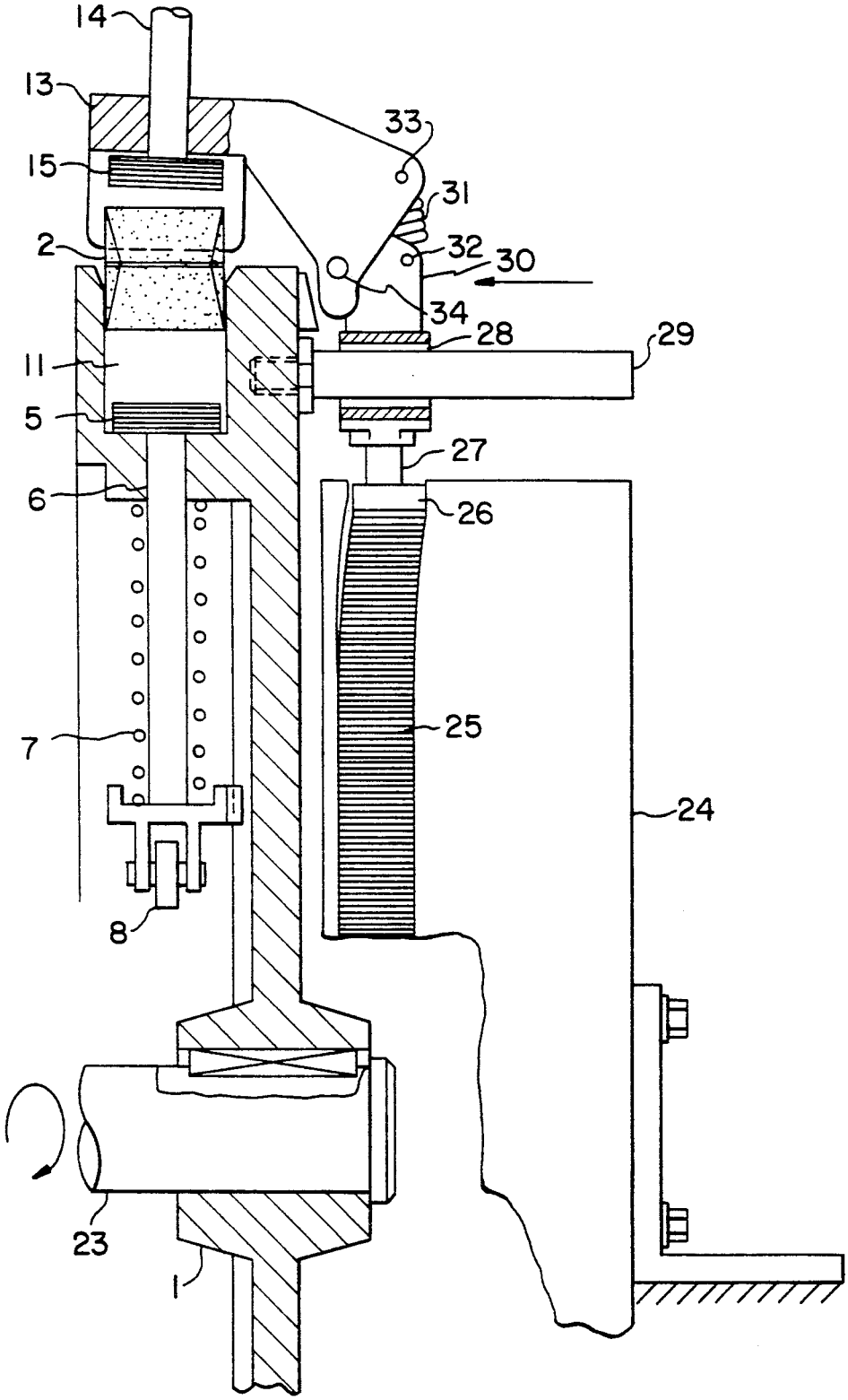
FIG. 15 shows a view of the device in a radial direction in the zone corresponding to FIG. 6.

In FIG. 7 the housing 13 shown on the left has adopted a position corresponding to that of FIG. 15. The housing 13 is thus positioned opposite its appropriate pocket 11.

Figure 16:
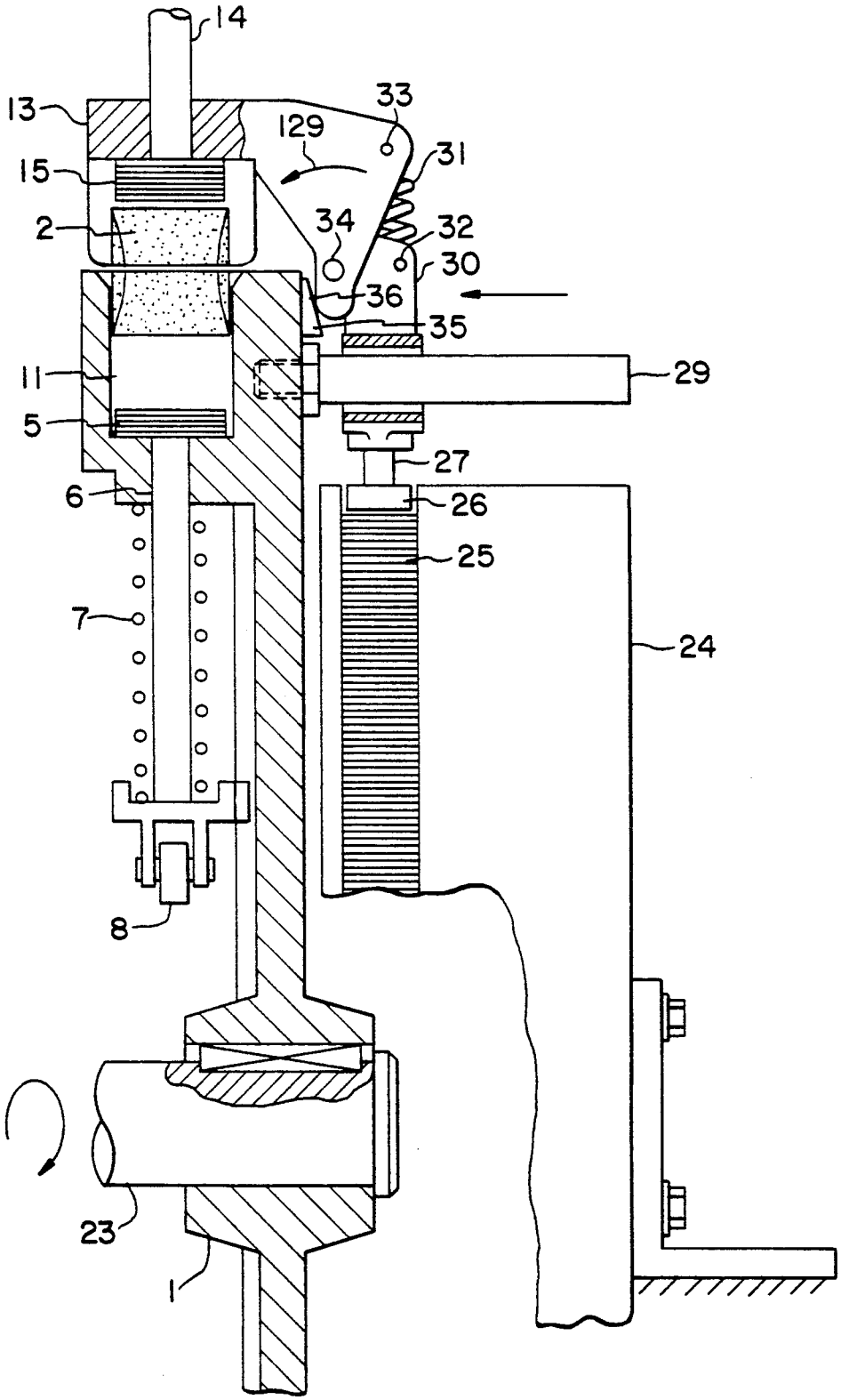
FIG. 16 shows a view of the device in a radial direction in the zone corresponding to FIG. 7.
Figure 17:
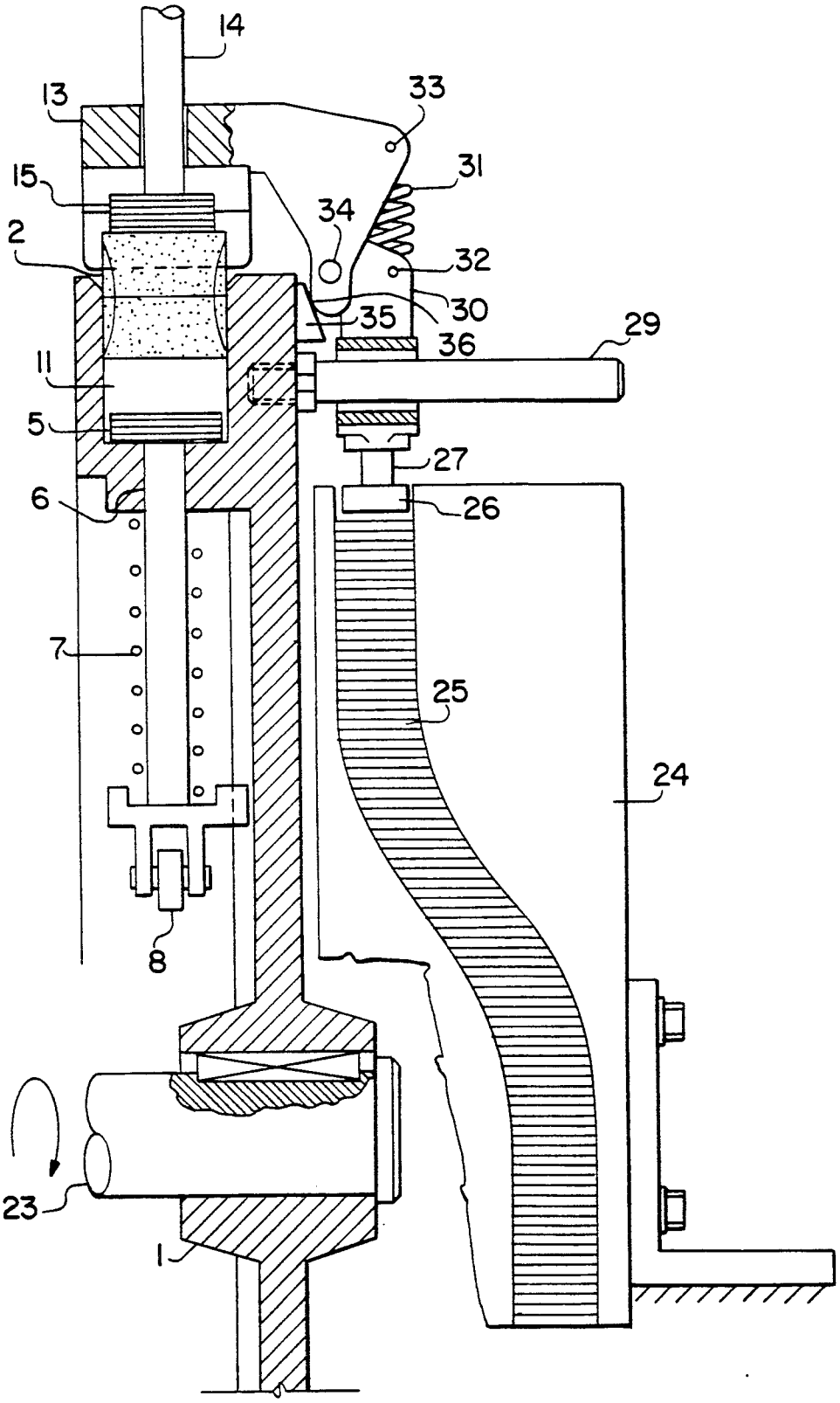
FIG. 17 shows a view of the device in a radial direction in the zone corresponding to FIG. 10.
Figure 18:
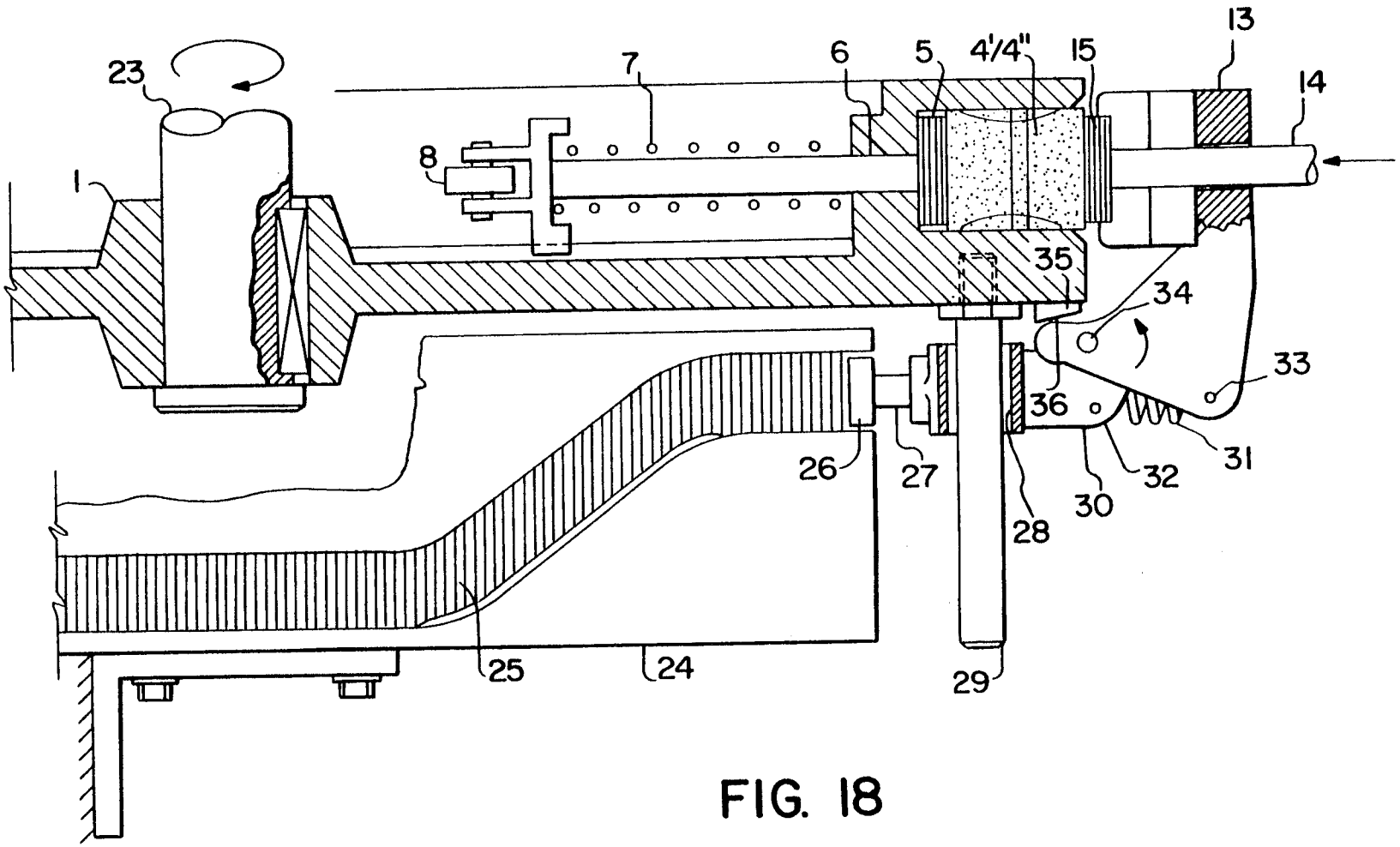
FIG. 18 shows a view of the device in a radial direction also in the zone corresponding to FIG. 10.

The housing 13 shown in the centre in FIG. 7 is in a position corresponding to that of FIG. 16. On the housing bracket 13 in FIG. 16 a guide lever 36 is provided radially inwards from the rotational axis 34 of the housing; this guide lever 36 interacts with the disc-mounted cam track 35 such that the housing 13 is moved towards the appropriate pocket 11. As a result of the interaction, therefore, of the guide lever 36 and the cam surface 35 the housing 13 is pivoted about the rotational axis 34 of the housing in the direction of the arrow 129 against the tensile force of the spring 31. This results in the housing 13 attaining the position shown in FIG. 7. This position is characterized in that the inner radial end zones 130 of the lateral walls of the housing 13 are pressed against the link zones of the container chain. The link zones are thus pressed together, namely between, on the one hand, the inner radial ends of the lateral walls of the housing 13 and, on the other, the outer radial periphery of the disc 102. The lateral, internal radial end zones of the housing 13 are bevelled such that they match the shape of the container.

FIG. 8 shows the action of the knives 16. Each knife 16 is mounted such that it is longitudinally displaceable in the zone between two pockets 11 on the disc 102 in a radial guideway 133. On its inner radial end it has a roller 18 which runs on a frame-mounted cam track 19. A compression spring 17 encompassing the knife 16 is located between a disc-mounted stop 134 and a stop 135 on the knife 16. Each knife 16 is thus pressure-loaded by this compression spring 17 such that normally, i.e. without any external influences, the knife together with its blade 138 on its outer radial end lies within the outer periphery of the disc 102, i.e. it is countersunk inside this disc. As a result of the action of the cam track 19 on the rollers 18 of the knives 16 the knives are moved radially outwards against the compressive force of the spring 17. In this way they sever the link zone of the container chain between two container zones.

FIG. 9 shows an enlarged representation of a knife immediately after severing a link zone.

FIG. 10 shows how the already singulated containers 4 are inserted into the pocket 11. This is achieved by means of the push plates 15 of the housings 13. As already stated, the push plates 15 are driven by a piston/-cylinder unit which is not shown in the drawings. The pockets 11 are shaped such that the singulated containers place their tabs against the pockets when being inserted. The containers are, therefore, forced into a cuboid shape.

Figure 11:
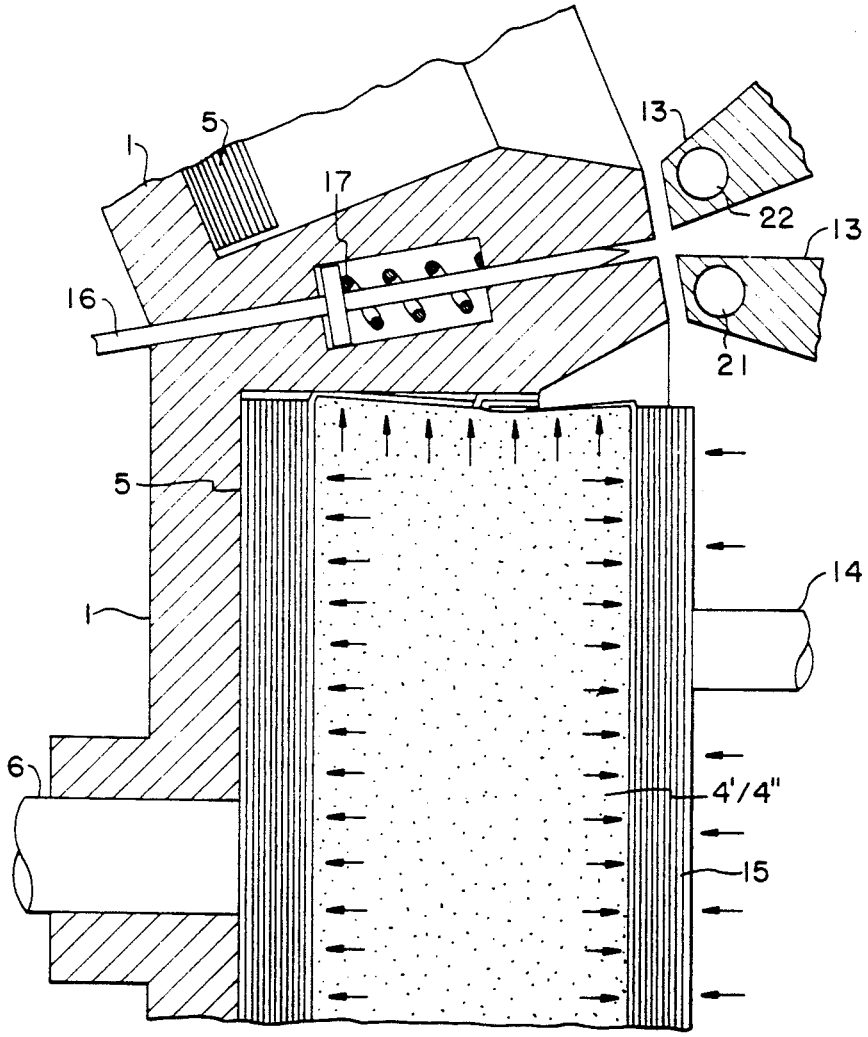
FIG. 11 shows an enlarged representation corresponding to FIG. 10.

FIG. 11 is an enlarged representation of this container cuboid shape 4'/4''.

Figure 12:
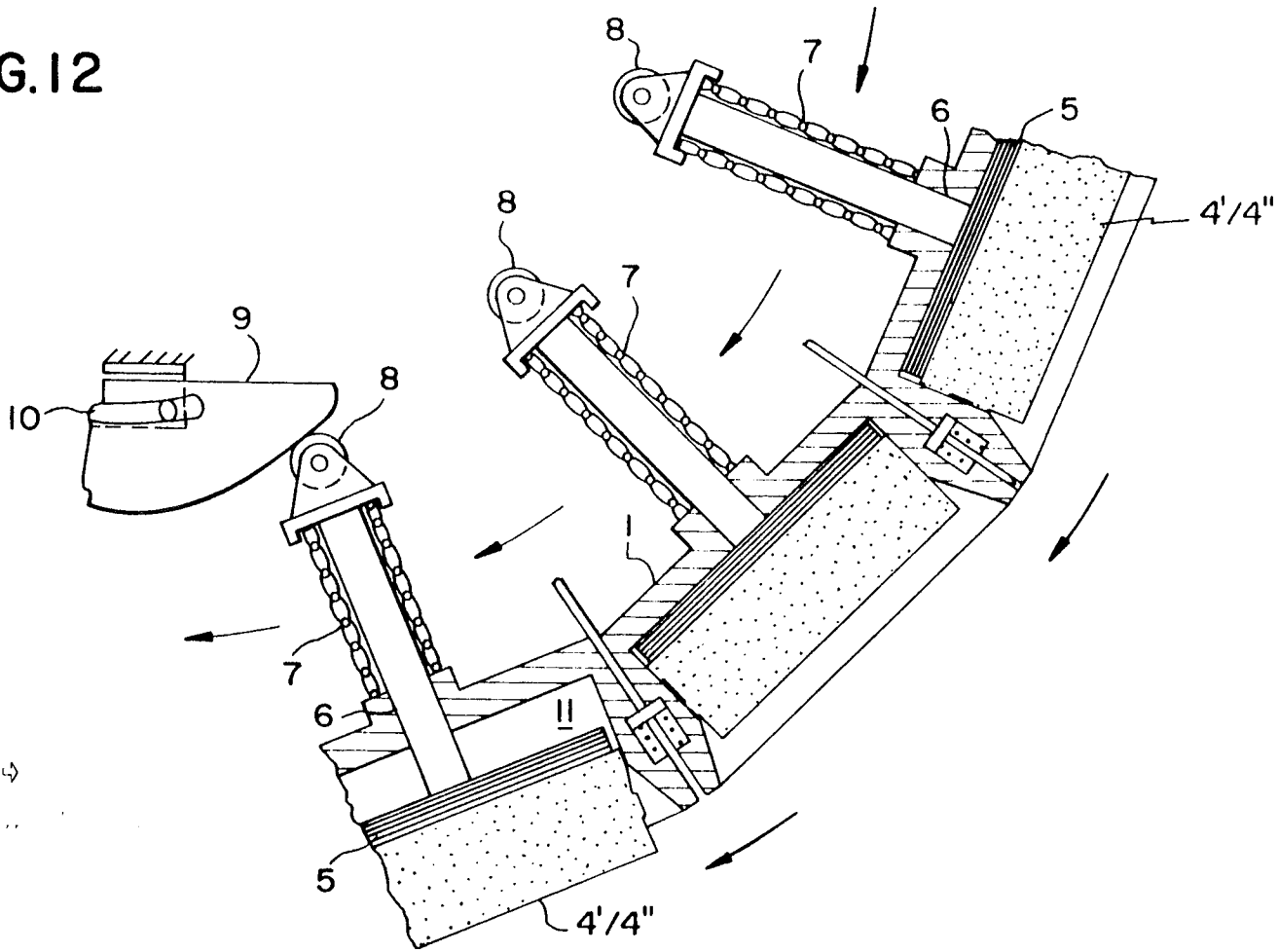
FIG. 12 shows the stage following on chronologically after FIG. 10 in which the container ends are welded.
Figure 12:
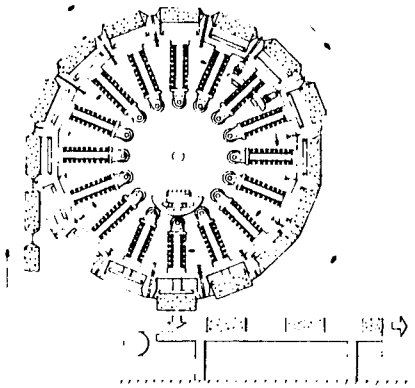
Figure 19:
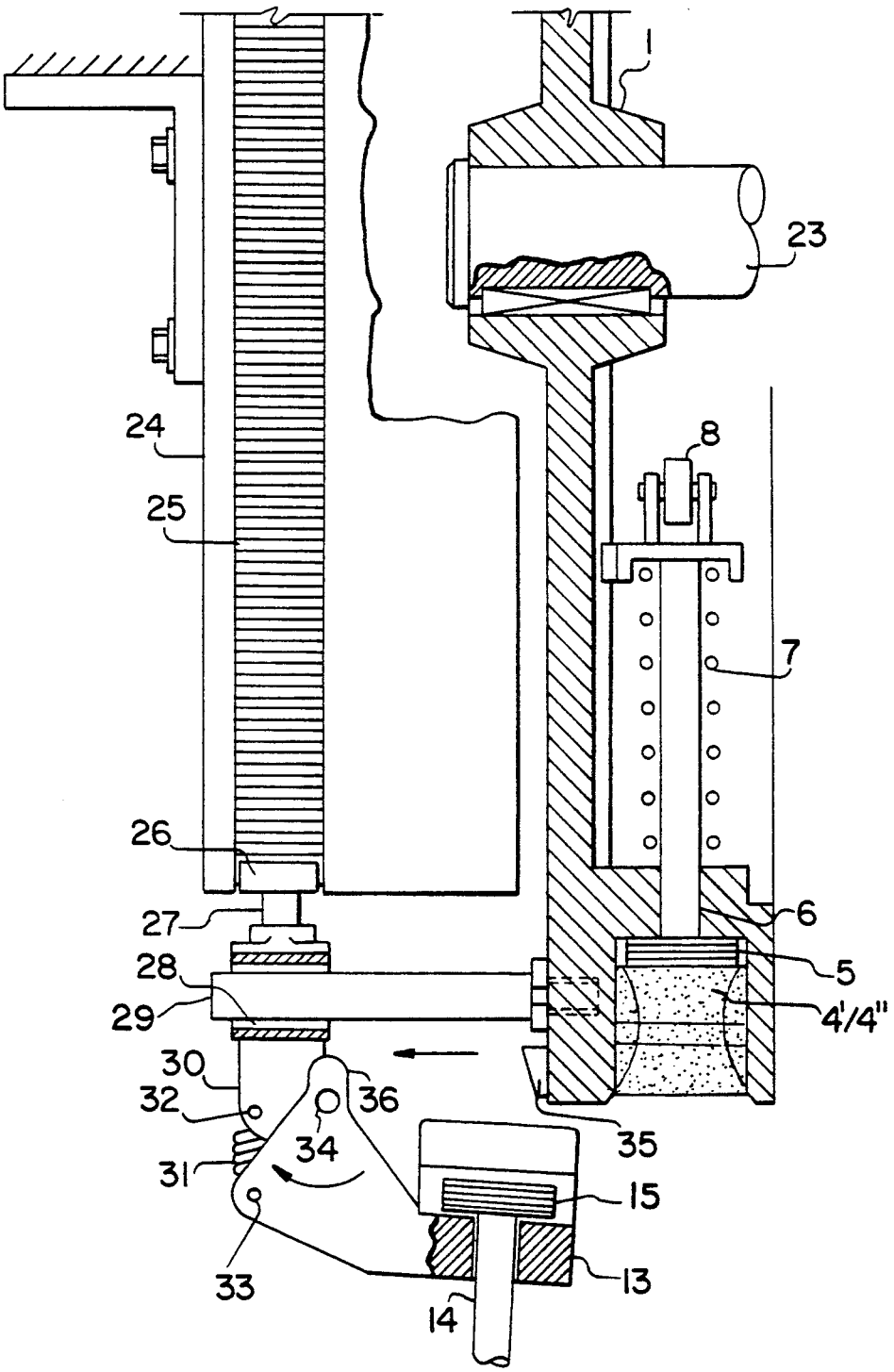
FIG. 19 shows a view of the device in a radial direction in the zone corresponding to FIG. 12.
Figure 20:
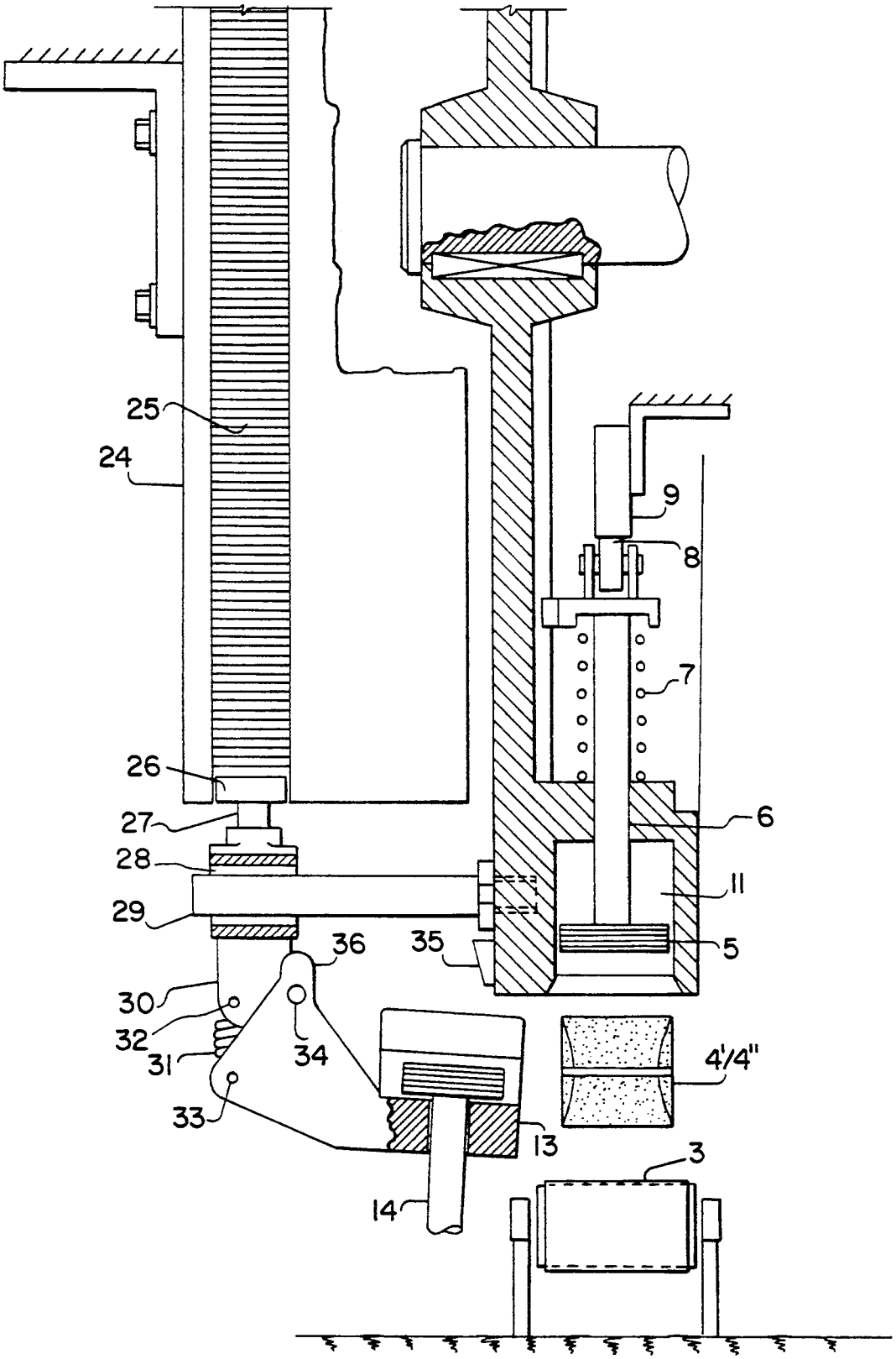
FIG. 20 shows a view of the device in a radial direction in the zone corresponding to FIG. 13.

In FIG. 12 the ends of the containers are being welded in the pockets. It is possible to choose to weld just one of the ends of each container or both ends simultaneously. FIG. 12 corresponds to the situation in FIG. 19. The housings have therefore moved away from the disc 102 again in an axial direction. This is controlled by the roller 26 and the cam track 25, as already described above.

FIG. 13 shows the discharge region of the disc again in a corresponding drawing to FIG. 3.

I claim:

1. A device for use in a packaging machine for continuous singulating of a plurality of packaging containers connected in a chain, said chain including a plurality of container zones joined by link zones, said device comprising:

a circular frame member rotatable about an axis, said frame member including a plurality of pockets uniformly spaced about said frame member for accepting said container zones of said chain and corresponding in size to said container zones, said frame member being rotatable and arranged to carry said container zones while guiding said chain along a predetermined circular path extending about at least 180 degrees of the periphery of said circular frame member; and a plurality of knives which are positioned at the same spacing as said link zones and, wherein said knives are reciprocatingly movable in a direction generally perpendicular to said frame member and said link zones to sever link zones, said pockets further including means for discharging said container zones after said link zones have been severed.

2. Device according to claim 1, characterized in that said circular frame member (102) is rotationally mounted in a horizontal axis (101) in the frame, and said container chain is guided along said circular path extending about the periphery thereof.

3. Device according to claim 2, characterized in that the pockets (11) are located on the peripheral surface of the disc (102) and comprise a base (111) extending tangentially to the disc periphery and lateral surfaces (112) connected radially to same.

4. Device according to claim 3, characterized in that a discharge plate (5) which is movable in a radial direction is provided on the base (111) of each pocket (11).

5. Device according to claim 4, characterized in that a radial guideway (113) is provided in the base (111) of each pocket (11) in which a gudgeon (115) is mounted such that it can be displaced longitudinally, said gudgeon having a discharge plate (5) on its outer radial end and a roller (8) which travels over a frame-mounted cam track (9) on its inner radial end.

6. Device according to claim 5, characterized in that a compression spring (7) encompassing the gudgeon (115) is provided between a stop on the pocket (11) and a stop on the gudgeon (115).

7. Device according to claim 7, characterized in that each knife (16) is mounted in a radial guideway (133) in the zone of the disc (102) between two pockets such that it is longitudinally displaceable.

8. Device according to claim 7, characterized in that a roller (18) is provided on the inner radial end of each knife (16) which travels over a frame-mounted cam track (19).

9. Device according to claim 8, characterized in that a compression spring (17) encompassing the knife (16) is located between a disc-mounted stop (134) and a stop (135) on the knife (16).

10. Device according to claim 9, characterized by:

(a) a housing-mounted cylinder (24) which is coaxial with the rotational axis (101) of the disc (102) and in the peripheral surface of which a guide slot (25) is provided;

(b) guide rods (29) each allocated to one pocket (11), which guide rods are firmly connected to the disc (102) and overlap the peripheral surface of the cylinder (24) parallel to the rotational axis (101) of the disc; and (c) housing brackets (30, 13) each allocated to a pocket (11) which can be displaced longitudinally along the guide rods (29), which brackets have on their inner radial end, a roller (26) tracking in the guide slot (25) of the cylinder (24) and, on their outer radial end, a radially inward facing housing (121) which consists of a tangential base (124) and two lateral surfaces (125) protruding radially inwards and which can be positioned opposite a pocket (11).

11. Device according to claim 10, characterized in that the base (124) of each housing (121) is provided with a radially movable push plate (15).

12. Device according to claim 11, characterized in that a radial guideway (124) is provided in the base (124) of each housing (121) in which a longitudinally displaceable gudgeon (14) is mounted which gudgeon has on its inner radial end to push plate (15) and which, on its outer radial end, is in the form of a piston of a piston/cylinder unit mounted on the housing (121).

13. Device according to claim 12, characterized in that:

(a) each housing (121) is mounted with a pivoting mount on a separator (30), which is mounted with longitudinal mobility on the guide rods (29) and supports the roller (26) which tracks in the guide slot (25) of the cylinder (24) about a tangentially acting rotating axis (34) for the housing which is located at the same distance from the rotational axis (101) of the disc as the peripheral surface of the disc; and (b) a guide lever (36) is provided, which can engage a disc-mounted cam track (35) such that the housing (13) can be moved towards the appropriate pocket (11) on the housing (13) radially inwards from the rotational axis (34) of the housing.

14. Device according to claim 13, characterised by a tensile spring (31) located between the housing (13) and the separator (30) to act on the housing (13) in the opposite direction to the pocket (11).

15. Device according to claim 14, characterized in that each pocket (11) in its outer radial zone has bevelled outward facing supporting faces (12).

16. Device according to claim 15, characterized in that each pocket (11) has a welding device in the region of the front end of the container.

17. Device according to claim 16, characterized in that each pocket (11) has a welding device in the region of the rear end of the container.

18. Device according to claim 17, characterized in that the welding devices are selectively usable.

19. Device according to claim 16, characterized in that the welding devices are selectively usable.

20. A device for use in a packaging machine for continuous singulating of a plurality of packaging containers connected in a chain, said chain including a plurality of container zones joined by link zones, said device comprising:

a circular frame member rotatable about an axis, said frame member including a plurality of pockets uniformly spaced about said frame member for accepting said container zones of said chain and corresponding in size to said container zones, said frame member being rotatable to guide said chain along a predetermined circular path; and an actuating member mounted adjacent said circular frame member and having a generally arcuately configured external periphery, said actuating member defining a guide slot extending about said periphery, guide means associated with each said pocket for rotation therewith and having means associated therewith for engagement with said guide slot as said frame member rotates, housing bracket means associated with each said pocket and displaceable longitudinally along each said associated guide means, said housing bracket means each having on the inner radial end, tracking means to engage and track said guide slot of said actuating member such that the position of each said housing bracket means relative to said frame means is determined by the position of said tracking means in said guide slot, a plurality of knives which are positioned at the same spacing as said link zones and, wherein said knives are reciprocatingly movable in a direction generally perpendicular to said frame member and said link zones to sever said link zones, said pockets further including means for discharging said container zones after said link zones have been severed.

* * * * *